US005713433A

United States Patent [19]

Wang

[11] Patent Number: 5,713,433

[45] Date of Patent: Feb. 3, 1998

[54] AUXILIARY ESCAPE OF ELEVATOR

[76] Inventor: Chiou Nan Wang, No. 50, Alley 97, Lane 354, Sanner Road, Fengyuan City, Taichung county, Taiwan

[21] Appl. No.: 531,689

[22] Filed: Sep. 21, 1995

[51] Int. Cl.[6] ..... B66B 11/08

[52] U.S. Cl. ..... 187/263; 187/350; 187/277

[58] Field of Search ..... 198/263, 350, 198/277

[56] References Cited

U.S. PATENT DOCUMENTS

| | | | |
|---|---|---|---|
| 78,829 | 6/1868 | Reedy | 187/263 |
| 119,829 | 10/1871 | Byrne | 187/263 |
| 368,256 | 8/1887 | Tilman | 187/263 |
| 383,958 | 6/1888 | Lincoln | 187/263 |
| 1,272,838 | 7/1918 | Moore | 187/263 |
| 2,265,891 | 12/1941 | Bertelsen | 187/263 |
| 2,725,957 | 12/1955 | Ferris | 187/350 |

FOREIGN PATENT DOCUMENTS

| | | | |
|---|---|---|---|
| 402270792 | 11/1990 | Japan | 187/263 |

*Primary Examiner*—William E. Terrell
*Assistant Examiner*—Khoi H. Tran
*Attorney, Agent, or Firm*—Pro-Techtor International

[57] ABSTRACT

An auxiliary device for operating a disabled elevator in case of emergency includes a pull cable and an action cable by which the disabled elevator can be raised or lowered to reach a desired floor. The pull cable is fastened at the top end thereof with one end of an application rod which is fastened pivotally at another end thereof in a control room located at the top of an elevator shaft. As the pull cable is pulled, an action rod is exerted on by the pressure of the application rod to disable the braking device so as to permit the elevator cab to be raised or lowered by a transmission box when the action cable is actuated.

3 Claims, 4 Drawing Sheets

AUXILIARY ESCAPE OF ELEVATOR

FIELD OF THE INVENTION

The present invention relates generally to an elevator, and more particularly to an auxiliary escape enabling the passengers of the elevator to escape when the elevator in operation is halted abruptly by a power stoppage or in an emergency.

BACKGROUND OF THE INVENTION

The normal operation of an elevator can be obstructed abruptly by a power stoppage or other incidents. As a result, the passengers of the disabled elevator might be trapped for hours. It is therefore conceivable that an elevator must be provided with an indispensable escape to safeguard the passengers of the elevator.

SUMMARY OF THE INVENTION

It is therefore the primary objective of the present invention to provide an elevator with an elevator cab which can be manually raised or lowered to reach a desired floor by means of a pull cable and an action cable when the elevator in motion is halted abruptly in an emergency.

It is another objective of the present invention to provide an elevator with an auxiliary escape device comprising an application rod which is fastened at one end thereof with a pull cable. As the pull cable is actuated, an action rod is pressed by the application rod to disable the braking device while a battery-powered motor is activated to drive an action wheel via two transmission wheels so as to drive the elevator cab to a desired floor.

DETAILED DESCRIPTION OF THE INVENTION

Figure 1:
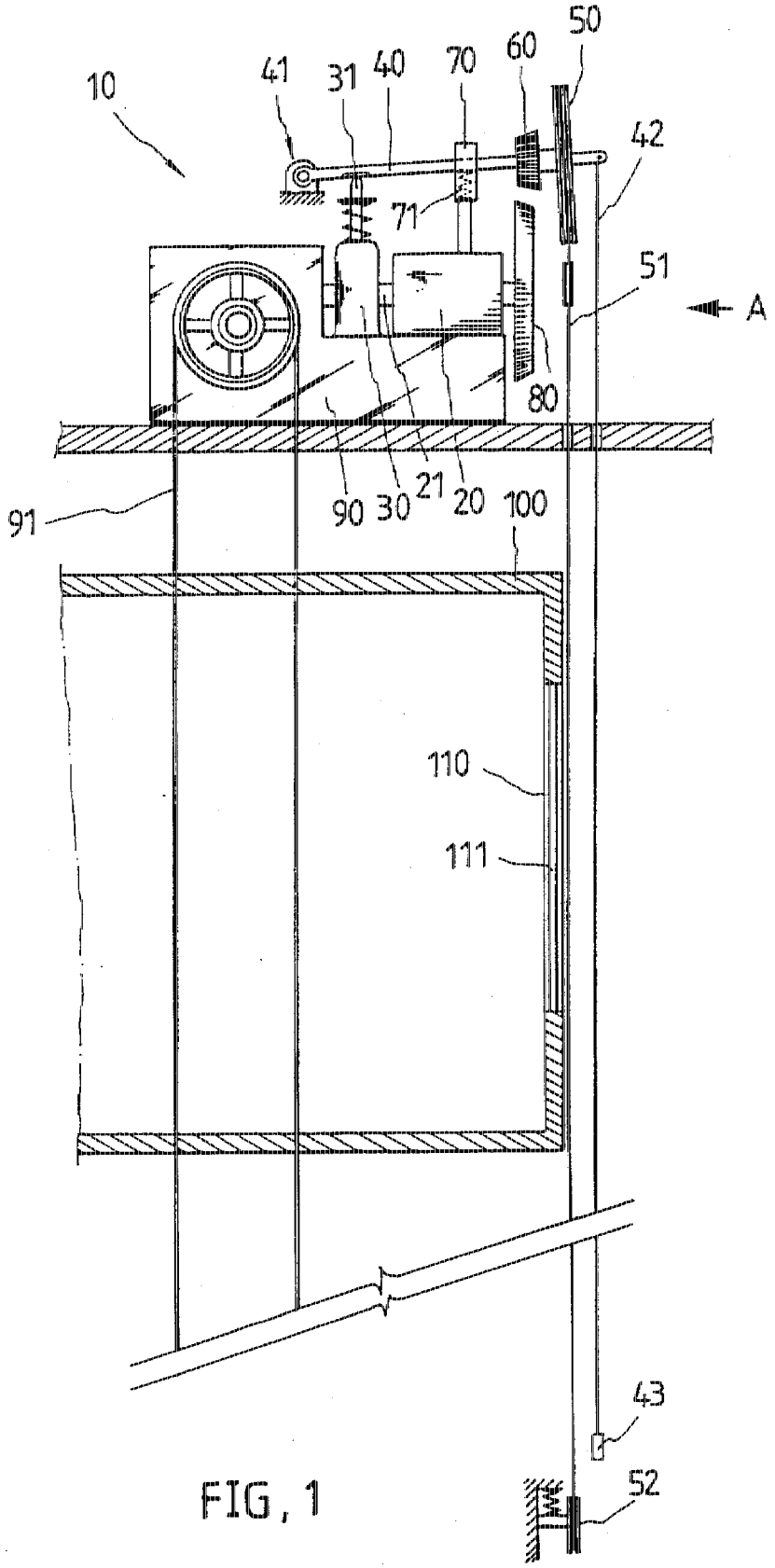
FIG. 1 shows a schematic plan view of a first preferred embodiment of the present invention.
Figure 2:
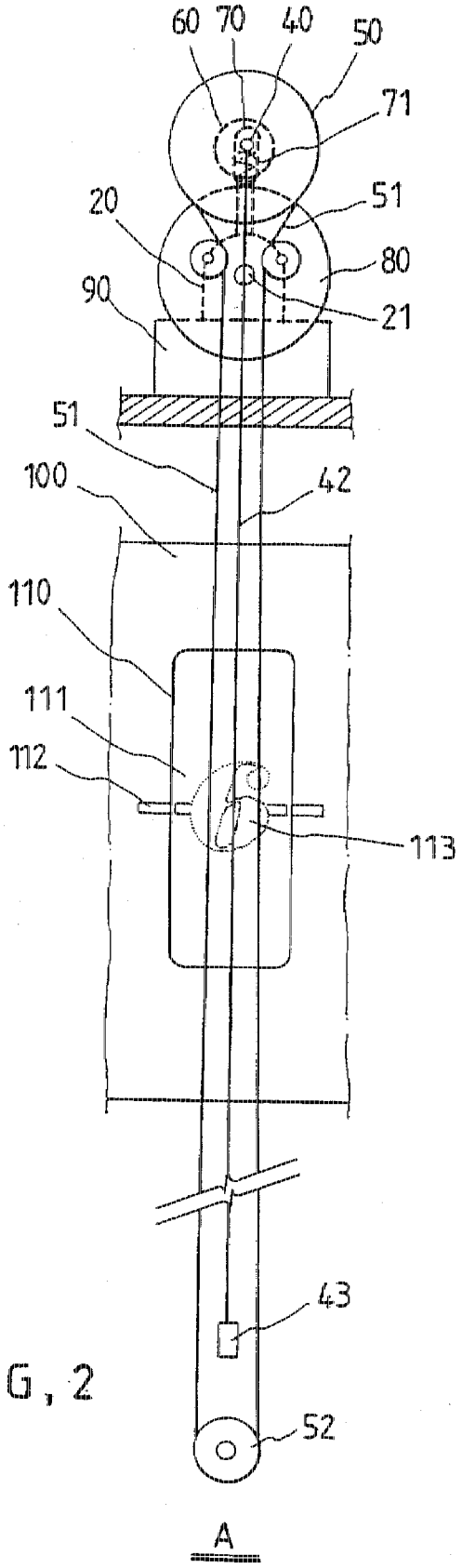
FIG. 2 shows a partial side view of the first preferred embodiment of the present invention.

As shown in FIGS. 1 and 2, an auxiliary device for operating an elevator in case of emergency includes a control room 10 which is located in the top end of the elevator shaft. The control room 10 is used to house a motor 20 having a transmission shaft 21 on which a braking device 30 is mounted. The braking device 30 is provided with an action rod 31 having a top end on which an application rod 40 is rested horizontally. The application rod 40 has a pivoting end 41 and a free end which is opposite to the pivoting end 41 and is fastened with the top end of a pull cable 42. Fastened with the bottom end of the pull cable 42 is a tension weight 43. A rotating wheel 50 is mounted on the free end of the application rod 40 and is provided with an action cable 51 which is wound thereon at the top end thereof. The bottom end of the action cable 51 is wound on an idle wheel 52. The application rod 40 is provided at the midsegment thereof with a support rod 70. Located between the rotating wheel 50 and the support rod 70 is a transmission wheel 60 which can be actuated to turn along with the rotating wheel 50. When the pull cable 42 is pulled downwards, the application rod 40 is caused to swing downwards on the pivoting end 41 thereof, thereby enabling the transmission wheel 60 to engage art action wheel 80 which is mounted on one end of the transmission shaft 21 of the motor 20.

Figure 3:
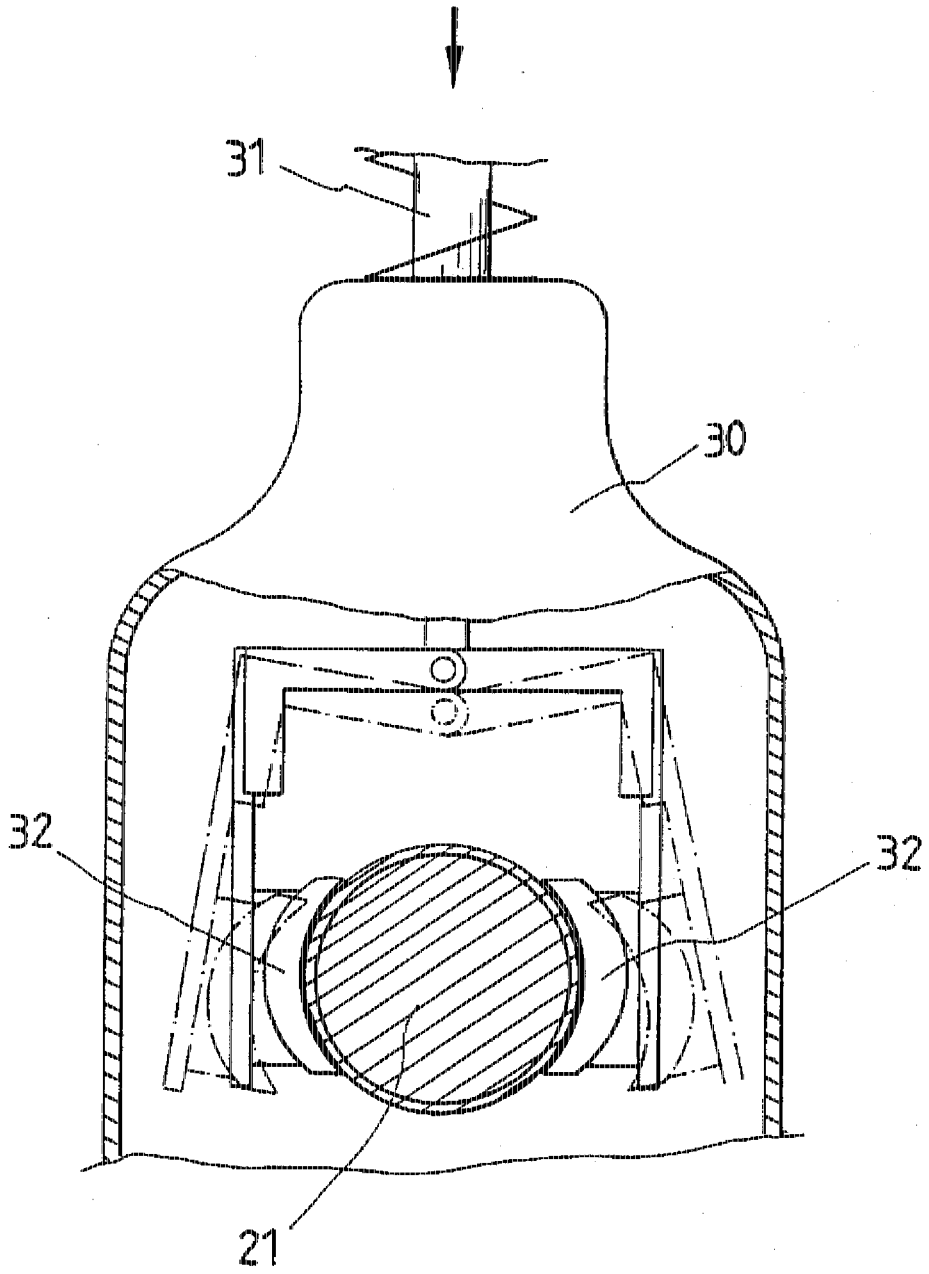
FIG. 3 is a schematic view showing the working relationship between the action rod and the braking device of the present invention.

As illustrated in FIG. 3, the brake shoes 32 of the braking device 30 are caused to disengage the transmission shaft 21 of the motor 20 when the pull cable 42 is pulled downwards to cause the application rod 40 to exert a pressure on the action rod 31 of the braking device 30. In the meantime, the transmission wheel 60 is caused to engage the action wheel 80. As the action cable 51 is pulled, the rotating wheel 50 is actuated to turn. As a result, the transmission wheel 60 is caused to turn along with the rotating wheel 50 so as to actuate the action wheel 80 engaging the transmission wheel 69. The motion of the action wheel 80 serves to actuate the transmission shaft 21 which in turn serves to actuate the machinery of a transmission box 90. The operation of the machinery of the transmission box 90 enables the elevator cable 91 to move the elevator cab 100 to a desired floor.

It must be noted here that the elevator cab 100 is provided with an emergency window 110 having a shield 111 of an acrylic material. In case of emergency, the shield 111 of the window 110 is broken forcibly so that, the trapped passengers have an easy access to the pull cable 42 and the action cable 51.

As the pull cable 42 is let go, the application rod 40 is caused to return to its original position by the force of the retrieving spring 71 of the support rod 70. In the meantime, the action rod 31 of the braking device 30 is relieved of the pressure exerting thereon by the application rod 40 so that the transmission shaft 21 of the motor 20 is once again arrested by the brake shoes 32 of the braking device 30, and that the operation of the transmission box 90 is interrupted to cause the elevator cab 100 to come to halt. The elevator cab 100 can be stopped precisely at a desired floor by observing through the window 110 to make sure that the horizontal line 112 of the window 110 is aligned with the desired floor number which is marked on the elevator shaft wall. Both the horizontal line 112 and the floor number marks are coated with a light-emitting substance to facilitate the observation.

Figure 4:
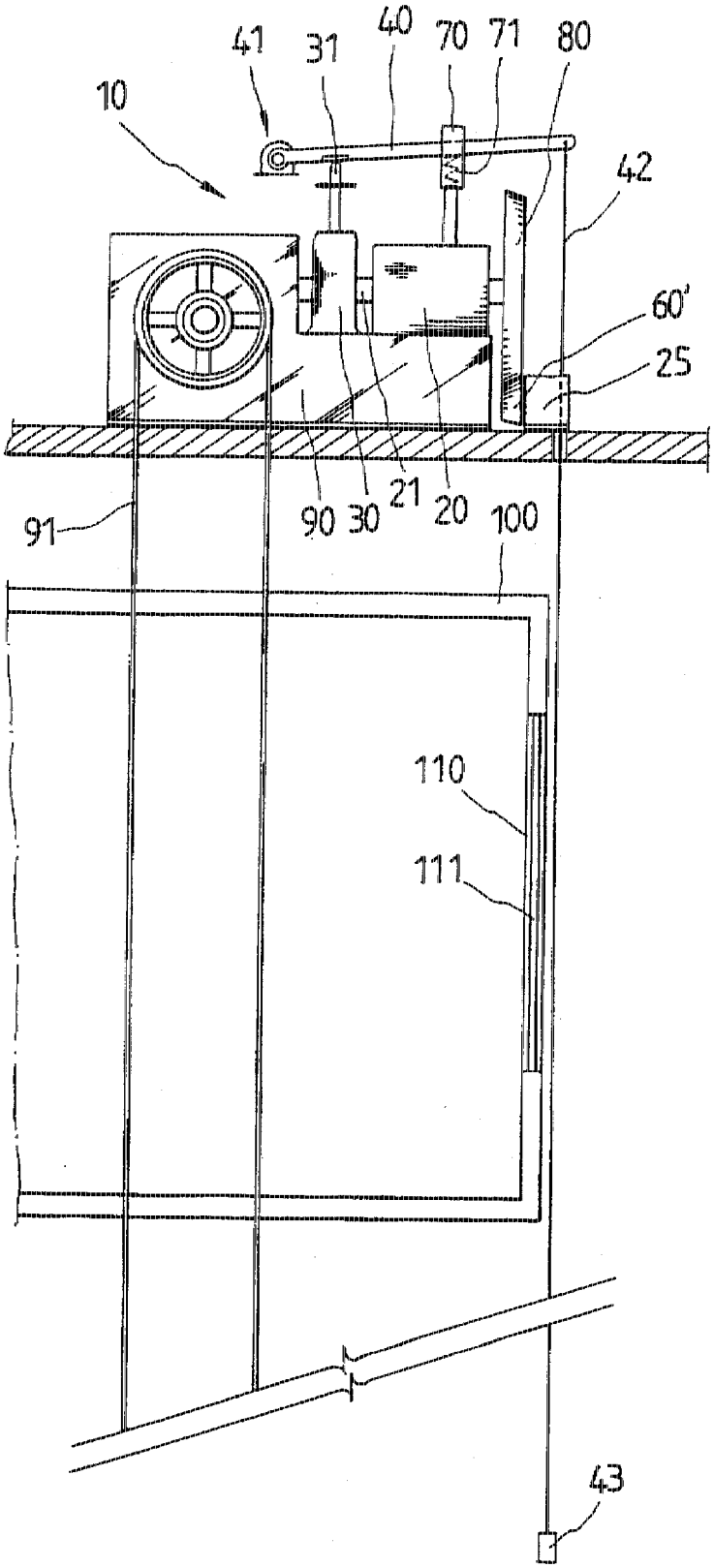
FIG. 4 shows a schematic plan view of a second preferred embodiment of the present invention.

As shown in FIG. 4, the second preferred embodiment of the present invention is provided with a battery-powered motor 25 capable of driving a transmission wheel 60' which is engageable with the action wheel 80. When the pull cable 42 is pulled to actuate the application rod 40 so as to disable the braking device 30, the battery-powered motor 25 is activated to drive the transmission wheel 60' which in turn actuates the action wheel 80 to turn. As a result, the transmission box 90 is activated to bring about the movement of the elevator cab 100 via the elevator cable 91.

The embodiments of the present invention described above are to be regarded in all respects as merely illustrative and not restrictive. Accordingly, the present invention may be embodied in other specific forms without deviating from the spirit thereof. The present invention is therefore to be limited only by the scope of the following appended claims.

What is claimed is:

1. An auxiliary device for an elevator comprising:

a control room located at a top of an elevator shaft, said control room houses a motor with a shaft, said shaft of said motor is in communication with an action rod of a braking device of said elevator such that said action rod is activated and deactivated by an application rod, said application rod includes a first end pivotally mounted to a fixed object, a pull cable attached to a free end of said application rod, said pull cable is suspended within said elevator shaft, a support rod affixed to said application rod, a transmission wheel mounted on said application rod such that said transmission wheel is situated between said support rod and a rotating wheel, said rotating wheel is rotatably mounted on said application rod, said transmission wheel aligns with an action wheel mounted on an end of said shaft of said motor, so that said transmission wheel turns with said rotating wheel when said rotating wheel is actuated by an action cable, said action cable has a top end affixed to said rotating wheel and a bottom end affixed to an idle wheel located at a bottom of said elevator shaft; wherein when said pull cable is actuated, said pull cable causes said application rod to apply pressure to said action rod, said pressure on said action rod disengages brake shoes of said braking device so as to release said shaft of said motor, and when said action cable is simultaneously actuated with said pull cable, said transmission wheel engages said action wheel to activate a transmission box so as to cause movement of an elevator cab of said elevator.

2. The auxiliary device as claimed in claim 1 wherein:

said elevator cab includes an opening that provides access to said action cable and said pull cable.

3. The auxiliary device as claimed in claim 1 wherein:

a second motor drives said action wheel to actuate said transmission box when said pull cable is actuated.

* * * * *